US006878914B2

(12) United States Patent
Kim

(10) Patent No.: US 6,878,914 B2
(45) Date of Patent: Apr. 12, 2005

(54) TIMER FOR MICROWAVE OVEN

(75) Inventor: Heung-Yi Kim, Suwon (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 487 days.

(21) Appl. No.: 10/170,380

(22) Filed: Jun. 14, 2002

(65) Prior Publication Data

US 2003/0117024 A1 Jun. 26, 2003

(30) Foreign Application Priority Data

Dec. 24, 2001 (KR) ..... 10-2001-84395

(51) Int. Cl.[7] ..... H05B 6/68
(52) U.S. Cl. ..... 219/719; 200/38 R; 200/35 R
(58) Field of Search ..... 219/400, 719, 219/703, 750, 736, 746, 715, 722, 414; 200/38 R, 38 B, 33 R, 35 R, 37 R, 37 A, 38 F, 38 FA, 38 FB, 38 D, 38 CA, 38 C, 38 BA; 307/141

(56) References Cited

U.S. PATENT DOCUMENTS 2,917,988 A * 12/1959 Harris ..... 99/327
3,548,126 A * 12/1970 Bassett ..... 200/38 R
3,596,015 A * 7/1971 Jullien-Davin ..... 200/38 BA
4,551,590 A * 11/1985 Mahon ..... 200/38 R
4,629,845 A * 12/1986 Mahon ..... 219/719
4,678,930 A 7/1987 Mahon

* cited by examiner

*Primary Examiner*—Quang T. Van
(74) *Attorney, Agent, or Firm*—Staas & Halsey LLP

(57) ABSTRACT

A timer for a microwave oven includes an actuating lever operating auxiliary power switch when pushed by a power control cam installed in a timer casing. A pushing unit is installed adjacent to the power control cam to move the power control cam up and down and pushes the power control cam so as to disconnect the actuating lever from the power control cam and hold the power switch on when a power level of the microwave oven is set to a maximum using a power control shaft. The pushing unit has a shaft part extending toward an intermediate gear disposed between the power contact shaft and the power cam. A compressing projection is provided on the intermediate gear pushing the shaft part of the pushing unit to move the power control cam.

35 Claims, 6 Drawing Sheets

TIMER FOR MICROWAVE OVEN

CROSS-REFERENCE TO RELATED APPLICATIONS

This application claims the benefit of Korean No. 2001-84395, filed Dec. 24, 2001 in the Korean Industrial Property office, the disclosure of which is incorporated herein by reference.

BACKGROUND OF THE INVENTION

1. Field of the Invention

The present invention relates generally to a timer for a microwave oven, and more particularly, to a timer holding a power switch to be turned on in a microwave oven when a power control shaft controlling an output power level of the microwave oven during the cooking period is set to a maximum output mode.

2. Description of the Related Art

Typically, a timer for a microwave oven is provided with a time control shaft and a power control shaft. The time control shaft is driven by a timer motor and used for setting a cooking time of the microwave oven. The power control shaft serves to control an output power level of the microwave oven by regulating an operation time of a magnetron during the cooking time.

The timer is also provided with a plurality of reduction gears coupled to the time control shaft, a timer cam, and a main power switch. The timer cam is mounted to the time control shaft and controls the main power switch to supply electric power to the microwave oven depending on a rotation of the time control shaft corresponding to the cooking time. The main power switch is selectively turned on in accordance with a rotation of the timer cam.

Further, the timer has an auxiliary power switch, a power control cam, and an actuating lever. The auxiliary power switch controls the supply of the electric power to the magnetron during the cooking time, thus controlling an output power level of the magnetron. The power control cam rotates by the timer motor and selectively turns on the auxiliary power switch depending on a power level mode of the power control shaft. The actuating lever turns on and off the auxiliary power switch while rotating by a predetermined rotating angle according to an operation of the power control cam. In this case, the timer is designed to control a contact of the actuating lever to contact the power control cam according to the power level mode of the power control shaft, thus determining an operation of the actuating lever. The auxiliary power switch is controlled by the operation of the actuating lever, thus controlling the output power level of the microwave oven.

However, the conventional timer for the microwave oven has a problem that the auxiliary power switch is unexpectedly off for a short time since the actuating lever is operated by the power control cam even when the power control shaft is set to the maximum output mode. The conventional timer has another problem that the service life time of the timer is shortened since a contact terminal of the auxiliary power switch is rapidly worn out due to frequent opening operations of the auxiliary power switch.

SUMMARY OF THE INVENTION

Accordingly, the present invention has been made to overcome the above and other problems of the related art, and an object of the present invention is to provide a timer for a microwave oven, which maintains an auxiliary power switch to be turned on when a power control shaft is set to a maximum output mode, thus preventing a contact terminal of the auxiliary power switch from being damaged, and therefore extending a service life time of the timer.

Additional objects and advantageous of the invention will be set forth in part in the description which follows and, in part, will be obvious from the description, or may be learned by practice of the invention.

In order to achieve the above and other objects, the present invention provides a timer for a microwave oven, having a time control shaft setting a cooking time, a timer motor rotating the timer shaft using a plurality of gears, a power control shaft controlling an output power level of the microwave oven during the cooking time, an auxiliary power switch controlling the supply of electric power to a magnetron of the microwave oven so as to control the output power level during the cooking time, a control gear shaft rotatably installed at a position spaced from the time control shaft having a control gear formed on one end of the control gear shaft, at least one intermediate gear disposed between a shaft gear of the power control shaft and the control gear of the control gear shaft to connect the power control shaft to the control gear shaft, a power control cam inserted around the control gear shaft so as to be rotatable and axially movable relative to the control gear shaft and to selectively turn off the auxiliary power switch, the power control cam rotating by the timer motor, and an actuating lever contacting the power control cam and rotating to a predetermined rotating angle according to a movement of the power control cam, thus selectively turning off the auxiliary power switch.

The timer includes a pushing unit disposed adjacent to a side of the power control cam to push the power control cam to disconnect the actuating lever from the power control cam and keep the auxiliary power switch on when an output power level of a microwave oven is set to the maximum output mode using the power control shaft, the pushing unit having a body and a shaft part extending from the body toward the intermediate gear and a compressing projection formed on the intermediate gear to push the shaft part of the pushing unit down with respect to the power control cam.

The timer is provided with a frame, a timer casing mounted on the frame and having the gears used for rotating the time control shaft, the power control cam, the auxiliary power switch, and the actuating lever, the frame rotatably supporting the power control shaft and the intermediate gear disposed outside the timer casing.

In the timer, a control gear of the control gear shaft is disposed outside the timer casing to be coupled with the intermediate gear, and the shaft part of the pushing unit extends through the timer casing to an outside of the timer casing such that the shaft part is in contact with the compressing projection of the intermediate gear.

The timer is provided with at least one first projection having a wedge shape and protruding from the control gear shaft toward the power control cam in order to control ON/OFF time of the auxiliary power switch when the control gear shaft rotates by the power control shaft, at least one second projection formed on the power control cam at a position corresponding to the first projection and axially pushed by a predetermined distance when the second projection is in contact with the first projection in accordance with the rotation of the power control cam such that the actuating lever disengages from an outer circumferential surface of the power control cam to turn the auxiliary power switch on, and a spring inserted around the control gear shaft and biasing the power control cam toward the first projection.

BRIEF DESCRIPTION OF THE DRAWINGS

These and other objects and other advantages of the present invention will become apparent and more readily appreciated from the following description of the preferred embodiments, taken in conjunction with the accompanying drawings of which:

FIG. 6 is a sectional view showing the power control unit set in the timer casing of the timer of FIG. 2, in which the auxiliary power switch is on.

DETAILED DESCRIPTION OF THE PREFERRED EMBODIMENTS

Figure 1:
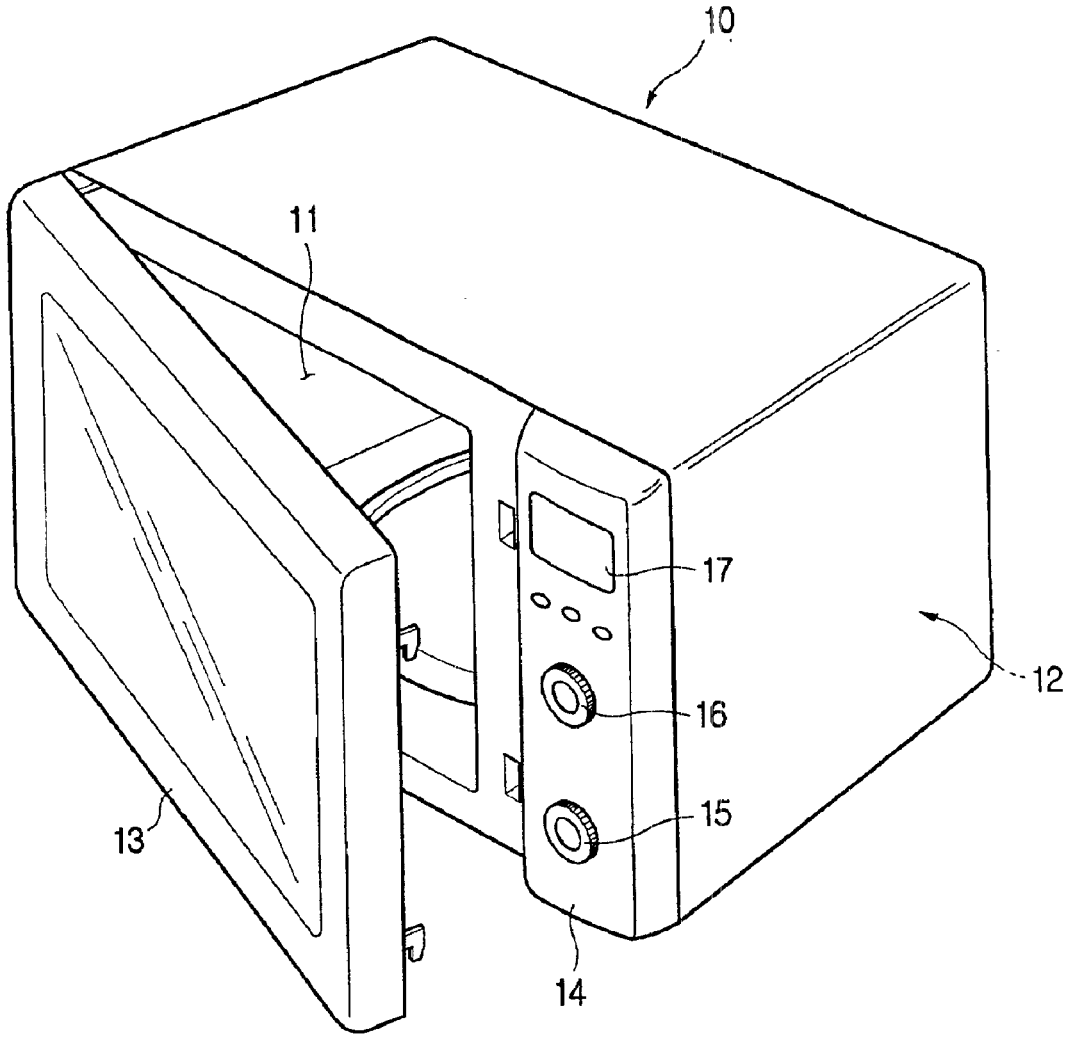
FIG. 1 is a perspective view of a microwave oven having a timer according to an embodiment of the present invention.

Reference will now be made in detail to the present preferred embodiments of the present invention, examples of which are illustrated in the accompanying drawings, wherein like reference numerals refer to the like elements throughout. The embodiments are described in order to explain the present invention by referring to the figures.

As shown in FIG. 1, a microwave oven including a timer according to an embodiment of the present invention has a body 10 which is partitioned into a cooking cavity 11 and a machine room 12. A door 13 is installed to a front wall of the cooking cavity 11 to be opened or closed. A control panel 14 is mounted to a front wall of the machine room 12 controlling an operation of the microwave oven and provided with a time adjusting knob 15 adjusting a cooking time, a power adjusting knob 16 adjusting an output power level of the microwave oven during the cooking time, and a display 17 displaying an operating state of the microwave oven.

Figure 2:
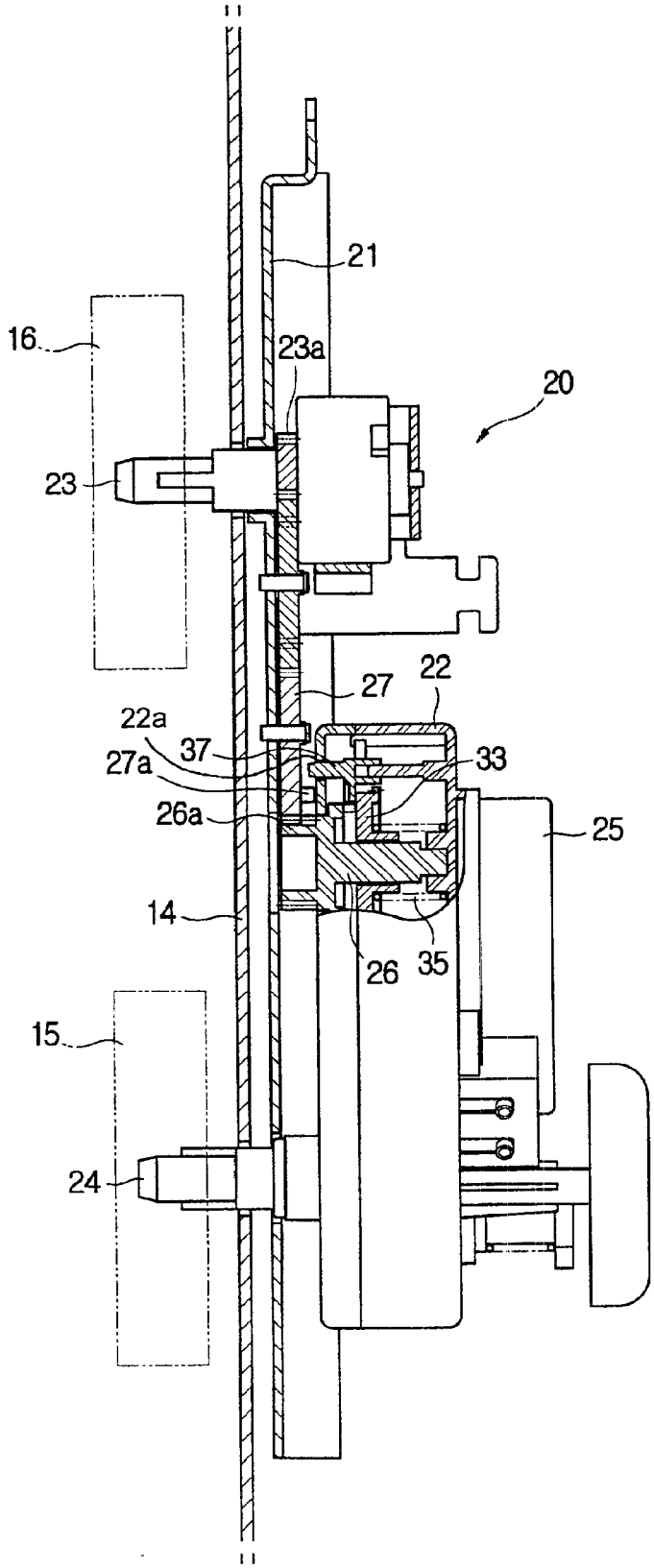
FIG. 2 is a side view showing the timer mounted on the microwave oven of FIG. 1.

Referring to FIG. 2, a timer 20 is installed on the control panel 14 and has a frame 21 and a timer casing 22 coupled to the frame 21. The frame 21 has a plate shape and is coupled to a rear surface of the control panel 14. As shown in the drawing, a power control shaft 23 is rotatably installed in an upper portion of the frame 21. The power control shaft 23 protrudes from a front wall of the control panel 14 and is coupled to the power adjusting knob 16. A time control shaft 24 extends from the timer casing 22 and is installed in a lower portion of the frame 21, and the time adjusting knob 15 is mounted on the time control shaft 24.

The timer 20 also has a timer motor 25 and at least one intermediate gear 27. The timer motor 25 is installed on an outer surface of the timer casing 22 and drives a plurality of gears which are disposed in the timer casing 22. The intermediate gear 27 is rotatably mounted on the frame 21 and transmits a rotating movement of the power control shaft 23 to a control gear shaft 26 disposed in the timer casing 22. Further, a shaft gear 23*a* is also provided on the power control shaft 23 to engage the intermediate gear 27.

A compressing projection 27*a* is formed on a surface of the intermediate gear 27. A pushing unit 37 is disposed within the timer casing 22 at a position corresponding to the compressing projection 27*a* when a maximum power mode as the output power level is set through the power control shaft 23. The compressing projection 27*a* protrudes toward the pushing unit 37 and pushes the pushing unit 37 up and down when the compressing projection 27*a* is engaged with the pushing unit 37. A control gear 26*a* coupled to the control gear shaft 26 rotates by the intermediate gear 27 rotating by the shaft gear 23*a* of the power control shaft 23. A power control cam 33 is rotatably inserted around the control gear shaft 26 and moves up and down along the control gear shaft 26 in response to the pushing unit 37 disposed between the power control cam 33 and the intermediate gear 27. A spring 35 is inserted around the control gear shaft 26 and disposed between the power control cam 33 and the timer casing 22. A hole 22*a* is formed on the timer casing 22 to allow the pushing unit protruding from the timer casing 22 to contact the compressing projection 27*a* of the intermediate gear 27. The power control shaft 23, the intermediate gear 27, and the compressing projection 27*a*, disposed outside the timer casing 22, form a power control shaft unit to control components disposed in the timer casing 22.

Figure 3:
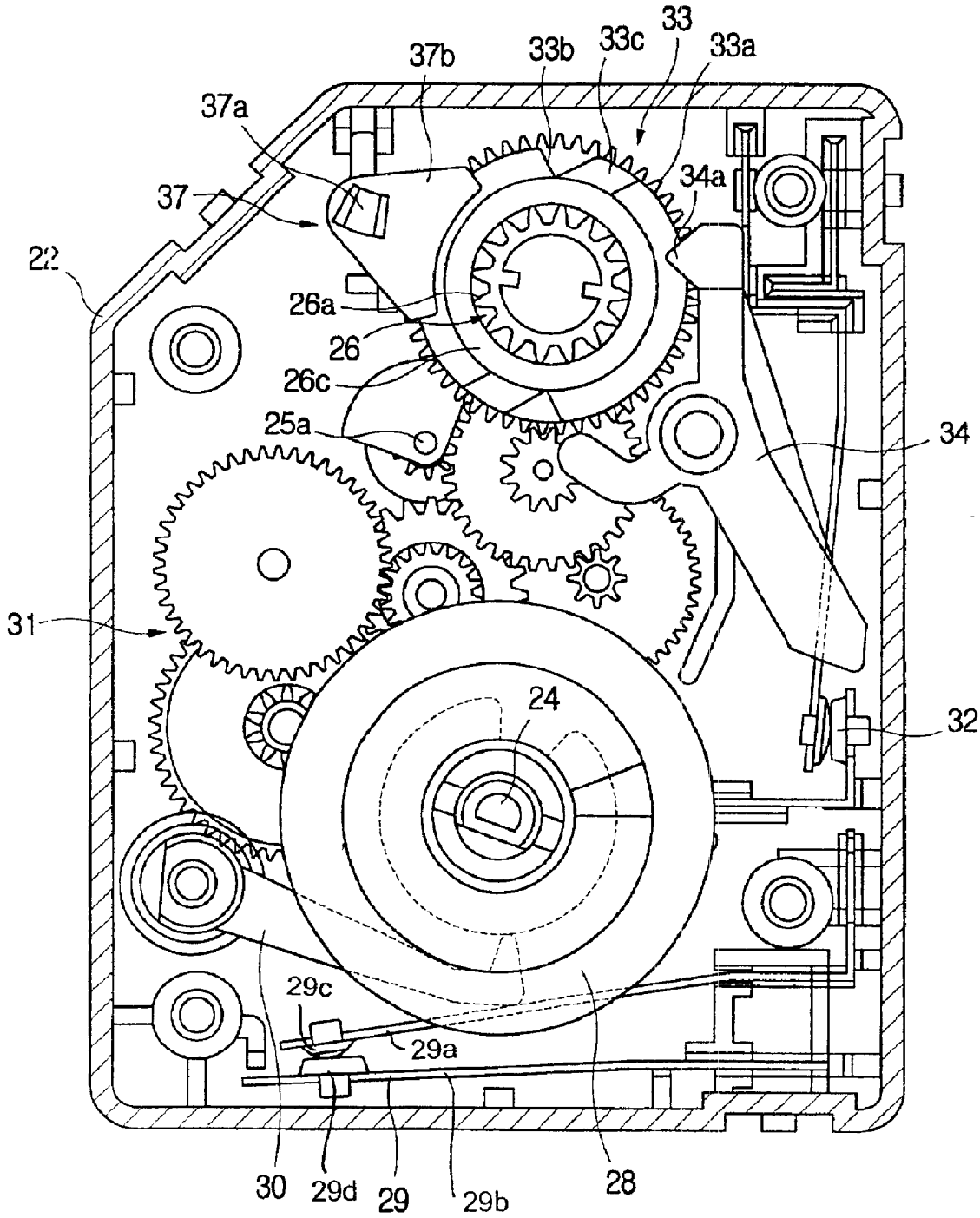
FIG. 3 is a plan view showing a timer casing of the timer of FIG. 2.

As shown in FIG. 3, there are a time control cam 28 and a main power switch 29 in the timer casing 22. The timer cam 28 is inserted around the time control shaft 24 and rotates to control the supply of the electric power to the microwave oven in response to a rotation of the time control shaft 24. The main power switch 29 selectively is turned on in response to the rotation of the time control cam 28. A lever 30 is rotatably installed between the time control cam 28 and the main power switch 29 and pushes a first main power switch leaf 29*a* against a second main power switch leaf 29*b* to connect contact terminals 29*c*, 29*d* of the main power switch 29 when the cooking time is set by a user rotating the time adjusting knob 15 coupled to the time control cam 28 to a predetermined angle. The first main power leaf 29*a* and the second main power switch leaf 29*b* are coupled to an external power source and a magnetron circuit of the microwave oven, respectively. A plurality of reduction gears 31 are installed between a timer motor shaft 25*a* of the timer motor 25 and the time control shaft 24 to form a speed reduction gear unit such that the time control shaft 24 rotates at a low speed when the timer motor 25 rotates.

An auxiliary power switch 32 is installed in the timer casing 22 and controls the output power level applied to the magnetron during the cooking time set by the time adjusting knob 15, thus controlling an output power level of the microwave oven. A power control unit is provided in the timer casing 22 at a position spaced apart from the time control shaft 24 so that contact terminals 32*a*, 32*b* of the auxiliary power switch 32 periodically contact each other to turn on the auxiliary power switch 32 in response to a power level mode of the power control shaft 23.

Figure 4:
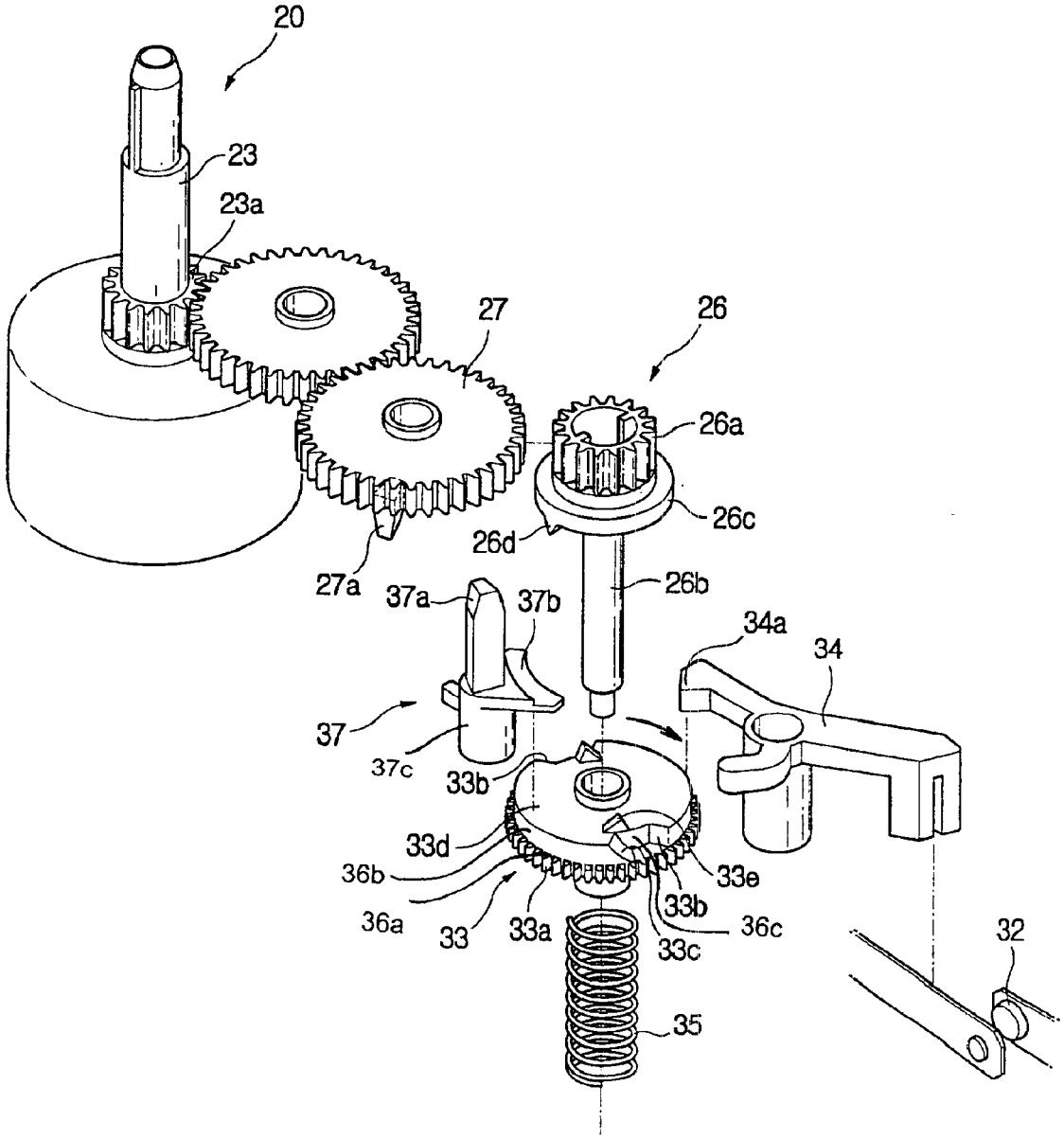
FIG. 4 is an exploded perspective view showing a power control unit included in the timer of FIG. 2.
Figure 5:
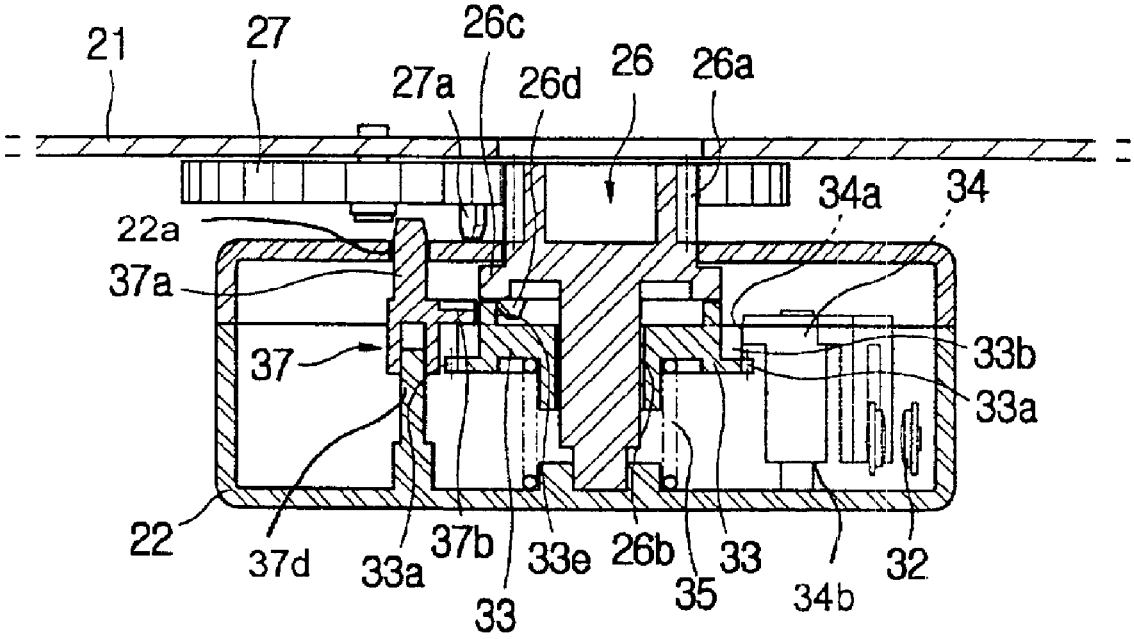
FIG. 5 is a sectional view showing the power control unit set in the timer casing of the timer of FIG. 2, in which an auxiliary power switch is off.

As shown in FIGS. 3 to 5, the power control unit includes the control gear shaft 26, the power control cam 33, and an actuating lever 34. The control gear shaft 26 is rotatably installed in the timer casing 22 and provided with the control gear 26*a* extended from the control gear shaft 26 and disposed outside the timer casing 22. The power control cam 33 is also rotatably inserted around the control gear shaft 26 disposed in the timer casing 22 and is axially movable along the control gear shaft 26 by a predetermined distance. The actuating lever 34 is rotatably installed in the timer casing 22 and rotates about a hinge 34*b* at a predetermined rotating angle according to the movement of the power control cam 33 while a contact part 34*a* of the actuating lever 34 contacts the power control cam 33, thus allowing the auxiliary power switch 32 to be turned on/off. The control gear shaft 26 and power control cam 33, disposed between the power control shaft unit and the actuating lever 34, form a control gear shaft unit to control the actuating lever 34 in response to the power control shaft unit.

Referring to FIGS. 4 and 5, the control gear shaft 26 includes a shaft part 26*b* and the control gear 26*a* formed on one end of the shaft part 26*b* and extends from an inside of the timer casing 22 to an outside of the timer casing 22 while another end of the shaft part 26*b* of the control gear shaft 26 is disposed in the timer casing 22. A step-shaped support 26*c* is installed at the junction between the control gear 26*a* and the shaft part 26*b*, is disposed within the timer casing 22 while the control gear 26*a* is disposed on the outside of the timer casing 22, and has an outer diameter larger than that of the control gear 26*a* so as to support the control gear shaft 26 on an inner surface of the timer casing 22. The control gear 26*a* disposed outside the timer casing 22 engages the intermediate gear 27 installed on the frame 21 to rotate by the movement of the power control shaft 23. The control gear shaft 26 rotates together with the power control shaft 23 when the power control shaft 23 rotates by the intermediate gear 27 transmitting the movement of the power control shaft 23 to the control gear 26*a* of the control gear shaft 26. The power control cam 33 rotates by the timer shaft 25*a* coupled to the timer motor 25 and controls the actuating lever while moving along the shaft part 26*b* of the control gear shaft 26.

The power control cam 33 has a disc shape with a predetermined thickness and is provided on a first outer circumferential side surface 36*a* with a gear portion 33*a* which engages one of the reduction gears provided in the timer casing 22, thus allowing the power control cam 33 to rotate with a first speed when the timer motor 25 rotates with a second speed higher than the first speed. At least one cam recess 33*b* having a predetermined depth is formed on a second outer circumferential side surface 36*b* of the power control cam 33 which is in contact with the contact part 34*a* of the actuating lever 34. An inclined surface 33*c* is formed in the cam recess 33*b* in a rotation direction of the power control cam 33 33*b* to connect the outer circumferential upper surface 33*d* to a lower portion of the cam recess 33*b*.

At least one first projection 26*d* is provided on the step shaped support 26*c* opposite to the control gear 26*a* so that the power control cam 33 periodically and axially moves along the shaft part 26*b* by a predetermined distance while rotating between the step shaped support 26*c* and the another end of the shaft part 26*b* of the control gear shaft 26. At least one second projection 33*e* is formed on the outer circumferential upper surface 33*d* of the power control cam 33 at a position corresponding to that of the first projection 26*d*. In this case, the first projection 26*d* having a wedge shape protrudes from the step shaped support 26*c* toward the outer circumferential upper surface 33*d* of the power control cam 33. The second projection 33*e* having the same wedge shape as the first projection 33*d* protrudes from the outer circumferential upper surface 33*d* of the power control cam 33 toward the step shaped support 26*c*. A spring 35 is inserted around the control gear shaft 26 and between the power control cam 33 and the timer casing 22, and elastically biases the power control cam 33 toward the first projection 26*d* so that the power control cam 33 moves along the shaft part 26*b* of the control gear shaft 26 between a first state turn turning on the auxiliary power switch 34 and a second state turning off the auxiliary power switch 34.

When the power control cam 33 is periodically and axially moved by the predetermined distance by the the first and second projections 26*d*, 33*e*, the contact part 34*a* of the actuating lever 34 is in contact with the second outer circumferential side surface 36*b* of the power control cam 33 or the outer circumferential upper surface 33*d* of the power control cam 33, thus rotating the actuating lever 34 about the hinge 34*b*. The auxiliary power switch 32 is periodically turned on/off by the movement of the actuating lever 34.

That is, when the power control cam 33 rotates while the contact part 34*a* of the actuating lever 34 enters the cam recess 33*b*, the contact part 34*a* of the actuating lever 34*b* is in contact with the inner circumferential side surface 36*c* of the cam recess 33*b* of the power control cam 33 so that the power switch 32 is turned off by the actuating lever 34. Further, when the power control cam 33 rotates while the contact part 34*a* of the actuating lever 34 is in contact with the second outer circumferential side surface 36*b* of the power control cam 33, and when the first projection 26*d* is in contact with the second projection 33*e*, the power control cam 33 is axially moved by the predetermined distance along the shaft part 26*b* of the control gear shaft 26. At this time, the contact part 34*a* of the actuating lever 34 is disengaged from the second outer circumferential side surface 36*b* of the power control cam 33 and then comes in contact with the outer circumferential upper surface 33*d* of the power control cam 33 so that the auxiliary power switch 32 is turned on by the movement of the actuating lever 34. A pair of contact terminals are formed on each leaf of the auxiliary power switch 32 to contact each other and separated from each other to turn on and off the auxiliary power switch 32. The inclined surface 33*c* of the cam recess 33*b* allows the contact part 34*a* of the actuating lever 34 to be smoothly changed from the first state where the contact part 34*a* is in contact with the side surface 33*d* of the power control cam 33 to the second state where the contact part 34*a* enters the cam recess 33*b*.

The timer 20 is also provided with a pushing unit 37 which is installed in the timer casing 22 at a position adjacent to the power control cam 33. When the power control shaft 23 rotates to maximize the output power level of the microwave oven, the pushing unit 37 pushes the output control cam 33 along the control gear shaft 26 so that the contact part 34*a* of the actuating lever 34 is disconnected from the second outer circumferential side surface 36*b* of the power control cam 33, thus maintaining the auxiliary power switch 32 on.

As shown in FIGS. 4 and 5, the pushing unit 37 includes a body 37*c*, a shaft part 37*a* and a fan-shaped pushing part 37*b*. The shaft part 37*a*, extended from the body 37*c*, is installed in the timer casing 22 in parallel to the control gear shaft 26, and axially moves by a second predetermined distance. The pushing part 37*b* extends from the shaft part 37*a* in a radial direction and pushes the outer circumferential upper surface 33*d* of the power control cam 33. The pushing unit 37 is supported by a support 37*d* and is biased toward the intermediate gear 27.

Referring to FIG. 5, the third projection 37*a* of the pushing unit 37 extends from the timer casing 22 toward the intermediate gear 27 driven by the power control shaft 23. The intermediate gear 27 is provided on one surface thereof with the compressing projection 27*a* which protrudes toward the third projection 37*a* of the pushing unit 37 when the compressing projection 27*a* is in contact with the third projection 37*a*. When the power control shaft 23 rotates to set the maximum power mode, the compressing projection 27*a* is disposed to contact and push the shaft part 37*a* of the pushing unit 37 away from the intermediate gear 27.

When the power control shaft 23 is set to the maximum output mode, the compressing projection 27*a* comes to contact the third projection 37*a* of the pushing unit 37 so as to push the third projection 37*a*, so that the pushing unit 37 pushes the power control cam 33 down. Thus, the first projection 26*d* is maintained to be spaced-apart from the second projection 33*e*. In addition, the contact part 34*a* of the actuating lever 34 is prevented from being in contact with the second outer circumferential side surface 36*b* of the power control cam 33, thus keeping the power switch 32 on.

An operation of the timer for the microwave oven according to this invention will be described hereinafter.

When the user rotates the time adjusting knob 15 at the predetermined rotating angle to set the cooking time, the timer cam 28 connected to the timer shaft 24 disposed in the timer casing 22 also rotates. At this time, the lever 30 in contact with the timer cam 28 allows the main power switch 29 to be connected to the power source, and thus the microwave oven is ready to cook. Further, the timer motor 25 operates to rotate the timer cam 28 for a preset time.

When it is required to set the output power level of the microwave oven during the cooking time after the cooking time is set by the timer shaft 24, the power control shaft 23 rotates to have a desired setting value as the output power level by the power adjusting knob 15. At this time, the control gear shaft 26 rotates to the predetermined rotating angle by the control gear 26*a* and the intermediate gear 27 engaged with the power control shaft 23. The first projection 26*d* provided on the step shaped support 26*c* of the control gear shaft 26 is thus rotated to a predetermined position and then maintains a stop condition.

In this case, since the power control cam 33 continues to rotate by the timer motor 25, the power control cam 33 is axially pushed for a short time by two projections 26*d* and 33*e* each having a wedge shape, when the second projection 33*e* is in a position around the first projection 26*d* while the power control cam 33 rotates. At this time, the actuating lever 34 enters the cam recess 33*b* of the power control cam 33 and then remains in contact with the second outer circumferential side surface 36*b* of the power control cam 33. Meanwhile, when the power control cam 33 is axially moved, the contact part 34*a* is repeatedly disconnected from the second outer circumferential side surface 36*b* of the power control cam 33 in a preset cycle, so the auxiliary power switch 32 is selectively on.

That is, when the power control cam 33 further rotates from a state where the contact part 34*a* of the actuating lever 34 is disposed in the cam recess 33*b*, the contact part 34*a* of the actuating lever 34 is in contact with the second outer circumferential side surface 36*b* of the power control cam 33. The power switch 32 is in an off mode. When the power control cam 33 further rotates, the second projection 33*e* comes into contact with the first projection 26*d* so that the power control cam 33 is axially pushed a predetermined distance. At this time, the contact part 34*a* of the actuating lever 34 is disconnected from the second outer circumferential side surface 36*b* of the power control cam 33 and brought into contact with the outer circumferential upper surface 33*d* of the power control cam 33, so the power switch 32 is returned to an on mode by a reverse movement of the actuating lever 34. When the power control cam 33 further rotates, the contact part 34*a* of the actuating lever 34 is guided to the inclined surface 33*c* of the cam recess 33*b* while entering the cam recess 33*b*, and then repeats the above operation, thus periodically turning the power switch 32 on.

In this case, when a setting value of the power control shaft 23 is increased or decreased, a position of the first projection 26*d* of the control gear shaft 26 is changed so that the ON/OFF time of the auxiliary power switch 32 is also changed. That is, when the output power of the microwave oven is decreased by rotating the power control shaft 23, the distance between the first projection 26*d* and the second projection 33*e* becomes distant when the contact part 34*a* of the actuating lever 34 enters the cam recess 33*b*, so the contact part 34*a* of the actuating lever 34 is in contact with the record outer circumferential side surface 36*b* of the power control cam 33 for a longer time. Thus, the 'ON' time of the auxiliary power switch 32 is shortened while the 'OFF' time is lengthened, so the output power of the microwave oven is decreased. On the contrary, when the output power of the microwave oven is increased by rotating the power control shaft 23, the first projection 26*d* becomes close to the second projection 33*e* when the contact part 34*a* of the actuating lever 34 enters the cam recess 33*b*, so the contact part 34*a* of the actuating lever 34 is in contact with the second outer circumferential side surface of the power control cam 33 for a shorter time. Thus, the 'ON' time of the power switch 32 is lengthened while the 'OFF' time is shortened, so the output power of the microwave oven is increased.

Figure 6:
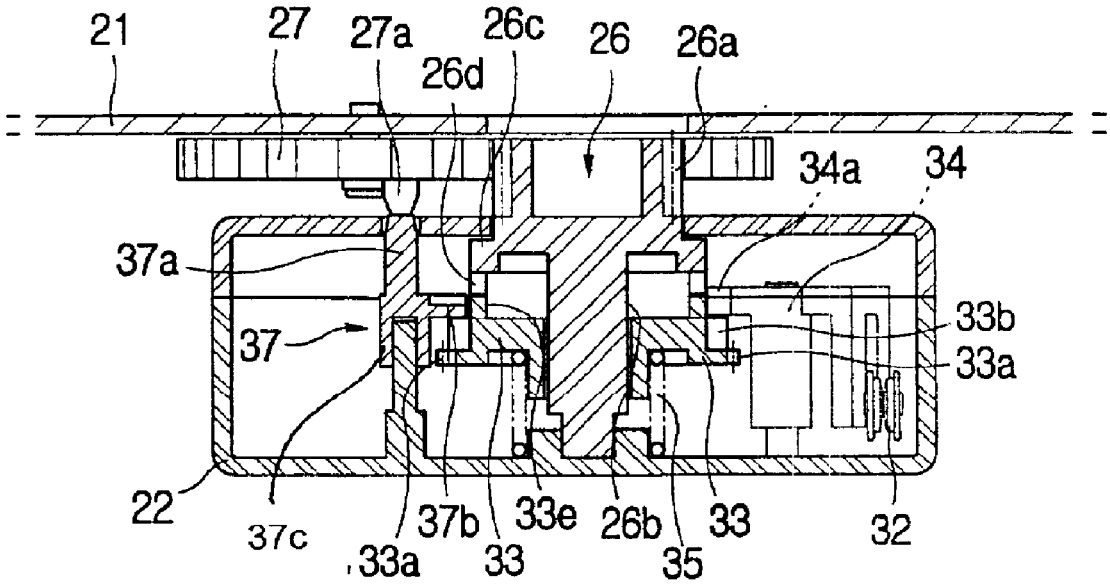

As shown in FIG. 6, when the power control shaft 23 rotates to maximize the output power of the microwave oven, the intermediate gear 27 coupled to the power control shaft 23 is rotated while the compressing projection 27*a* of the intermediate gear 27 pushes the third projeciton 37*a* of the pushing unit 37 down, so the pushing unit 37 maintains the power control cam 33 to be down. In this case, the first projection 26*d* is prevented from being in contact with the second projection 33*e*, and besides, the contact part 34*a* of the actuating lever 34 is prevented from being in contact with the second outer circumferential side surface 36*b* of the power control cam 33. Under this condition, if the power control cam 33 rotates, the power switch 32 is on. At this time, since the electric power is continuously applied to the magnetron, the output power of the microwave oven is maximized.

As described above, the present invention provides the timer for the microwave oven having the pushing unit pushing the power control cam up or down with respect to the control gear shaft to maintain the auxiliary power switch in the on state when the power control shaft is set to the maximum output mode, therefore preventing a contact terminal of the auxiliary power switch from being damaged as well as extending a service life time of the timer.

Although a few preferred embodiments of the present invention have been shown and described, it would be appreciated by those skilled in the art that changes may be made in this embodiment without departing from the principles and sprit of the invention, the scope of which is defined in the claims and their equivalents.

What is claimed is:

1. A timer for use in a microwave oven, having a time control shaft setting a cooking time, a timer motor rotating the time control shaft by a plurality of gears, a power control shaft controlling an output power level during the cooking time and controlling an auxiliary power switch to supply electric power to a magnetron in response to the output power level, a control gear shaft spaced apart from the time control shaft having a shaft part and a control gear, at least one intermediate gear disposed between the power control shaft and the control gear of the control gear shaft to connect the power control shaft to the control gear shaft, a power control cam inserted around the shaft part of the control gear shaft to move along the control gear shaft and selectively turn on and off the auxiliary power switch, the power control cam rotating by the timer motor, and an actuating lever contacting the power control cam to rotate to a predetermined rotating angle according to the power control cam and selectively turning on and off the auxiliary power switch, the timer comprising:

a pushing unit movably installed adjacent to a side of the power control cam and pushing the power control cam to disconnect the actuating lever from the power control cam and keep the auxiliary power switch on when the output power level of the magnetron of the microwave oven is set to a maximum power level using the power control shaft, the pushing unit having an extension extending toward the intermediate gear; and a compressing projection formed on the intermediate gear to control the extension of the pushing unit to move the power control cam.

2. The timer according to claim 1, further comprising:

a timer casing including a reduction gear unit used for rotating the time control shaft and the power control cam; and a frame connected to the timer casing to support the power control shaft and the intermediate gear disposed outside the timer casing.

3. The timer according to claim 2, wherein said control gear of the control gear shaft is disposed outside the timer casing to engage the intermediate gear, and the extension of the pushing unit extends through the timer casing to the outside of the timer casing such that the extension is in contact with the compressing projection of the intermediate gear.

4. The timer according to claim 1, further comprising:

at least one first projection protruding from the control gear shaft toward the power control cam;

at least one second projection provided on the power control cam at a position corresponding to the first projection and axially pushed by a predetermined distance when the second projection is in contact with the first projection in accordance with a rotation of the power control cam such that the actuating lever disengages from the power control cam to turn on the auxiliary power switch; and a spring inserted around the control gear shaft to bias the power control cam toward the first projection.

5. A timer in a microwave oven having a magnetron, comprising:

a main power switch adapted to be coupled to an external power source;

a timer control unit turning on the main power switch during a predetermined period of time;

a power control shaft unit enabling a user to set a plurality of power levels of the magnetron during the predetermined period;

an auxiliary power switch to activate a magnetron in response to one of the power levels;

a control gear shaft unit intermittently turning on and off the auxiliary power switch in response to the power control shaft unit during the predetermined period; and a pushing unit disposed between the power control shaft unit and the control gear shaft unit to cause the control gear shaft unit to maintain the auxiliary power switch in an on state when the one of the power levels is a maximum power level set through the power control shaft and when the power control shaft unit contacts the pushing unit.

6. The timer according to claim 5, wherein the pushing unit controls the control gear shaft unit to stop intermittently turning on and off the auxiliary power switch when the one of the power levels is the maximum power level set through the power control shaft and when the power control shaft unit contacts the pushing unit.

7. The timer according to claim 5, wherein the control gear shaft unit comprises:

a control gear shaft rotating by the power control shaft unit; and a power control cam moving in a first state turning on the auxiliary power switch and a second state turning off the auxiliary power switch in response to the control gear shaft, wherein the pushing unit holds the power control cam to move to the first state to maintain the auxiliary power switch in the on state.

8. The timer according to claim 7, wherein the control gear shaft comprises:

a control gear formed on one end of the control gear shaft;

a shaft part formed on another end of the control gear shaft; and a first projection formed on the control gear shaft, wherein the power control cam moves to the first state turning on the auxiliary power control switch when the first projection contacts the power control cam.

9. The timer according to claim 8, wherein the power control cam comprises:

a second projection corresponding to the first projection, wherein the power control cam moves to the first state turning on the auxiliary power control switch when the first projection contacts the second projection.

10. The timer according to claim 9, wherein the first and second projections each has a wedge shape.

11. The timer according to claim 9, wherein the first projection is disposed at a position corresponding to the one of the power levels while the second projection rotates together with the power control cam.

12. The timer according to claim 11, wherein the first projection of the control gear shaft rotates by the power control shaft unit to the position when the one of the power levels is set by the user through the power control shaft while the second projection rotates together with the power control cam.

13. The timer according to claim 7, further comprising an actuating lever disposed between the power control cam and the auxiliary power switch, wherein the actuating lever turns on and off the auxiliary power switch when the one of the power levels is not the maximum power level.

14. The timer according to claim 13, wherein the power control cam comprises a side surface, wherein the actuating lever turns on the auxiliary power switch when one end of the actuating lever is disposed at the side surface of the power control cam.

15. The timer according to claim 14, wherein the power control cam comprises a recess, wherein the actuating lever turns off the auxiliary power switch when one end of the actuating lever is disposed in the recess of the power control cam.

16. The timer according to claim 15, wherein the power control cam comprises a inclined surface formed between an upper surface and a lower surface of the recess to guide the actuating lever moving between the upper surface of the power control cam and the lower surface of the recess, wherein the actuating lever turns on the auxiliary power switch when one end of the actuating lever is disposed on the upper surface when the power control cam moves in the first state.

17. A timer in a microwave oven having a magnetron, comprising:

a timer motor;

a time control shaft to enable a user to set a predetermined period of time;

a main power switch adapted to be coupled to an external power source;

a timer control unit rotating by the timer motor and turning on the main power switch during the predetermined period;

a power control shaft enabling a user to set a plurality of power levels of the magnetron;

an auxiliary power switch adapted to activate the magnetron in response to one of the power levels;

a control gear shaft rotating by the power control shaft and disposed at a predetermined position in response to the one of the power levels;

a power control cam rotating by the timer motor and intermittently turning on and off the auxiliary power switch during the predetermined period when control gear shaft controls the power control cam; and a pushing unit disposed between the power control gear shaft and the power control cam to control the power control cam to move between a first state and a second state while rotating by the timer motor, the power control cam intermittently turning on and off the auxiliary power switch in the first state while being held to turn on the auxiliary power switch in the second state when the one of the power levels is a maximum power level.

18. The timer according to claim 17, wherein the power control cam stops intermittently turning on and off the auxiliary power switch in the second state.

19. The timer according to claim 17, further comprising an intermediate gear disposed between the power control shaft and the control gear shaft to connect the power control shaft to the control gear shaft.

20. The timer according to claim 19, wherein the intermediate gear comprises a protrusion formed on the intermediate gear, wherein the protrusion contacts the pushing unit to cause the power control cam to move from the first state to the second state when the maximum power level is set.

21. The timer according to claim 20, wherein the pushing unit comprises:

a body;

an extension extended from the body toward the intermediate gear;

a pushing part extended from the body toward the control gear shaft to push the power control cam to move from the first state to the second state when the protrusion of the intermediate gear contacts the extension of the pushing unit in response to the maximum power level.

22. The timer according to claim 21, wherein the pushing part is formed around the body to have a fan-shape.

23. The timer according to claim 21, wherein the pushing part is perpendicular to one of the body and the extension.

24. A timer in a microwave oven having a magnetron, comprising:

a timer casing unit comprising:

a timer motor, a time control shaft disposed within the timer casing unit and extended toward an outside of the timer casing to enable a user to set a predetermined period of time, a main power switch adapted to be coupled to an external power source, a timer control unit rotating by the timer motor and turning on the main power switch during the predetermined period, a power control shaft unit disposed within the timer casing unit to enable the user to set a plurality of power levels of the magnetron, an auxiliary power switch adapted to activate the magnetron in response to one of the power levels, a control gear shaft rotating by the power control shaft and disposed at a predetermined position in response to the one of the power levels, and a power control cam rotating by the timer motor and intermittently turning on and off the auxiliary power switch during the predetermined period when the control gear shaft controls the power control cam; and a pushing unit disposed within the timer casing unit and between the control gear shaft and the power control cam to control the power control cam to move between a first state and a second state while rotating by the timer motor, the power control cam intermittently turning on and off the auxiliary power switch in the first state while being held to turn on the auxiliary power switch in the second state when the one of the power levels is a maximum power level.

25. The timer according to claim 24, wherein the pushing unit is disposed at a position to contact the power control shaft unit when the maximum power level is set.

26. The timer according to claim 24, wherein the auxiliary power switch stops being intermittently turned on and off and is maintained to be turned on when the pushing unit holds the power cam in the second state in accordance with the maximum power level.

27. The timer according to claim 24, wherein the pushing unit disconnects the power control cam from the auxiliary power switch when the maximum power level is set.

28. The timer according to claim 24, further comprising a frame having holes, wherein the timer casing unit is attached to the frame, and wherein the time control shaft and the power control shaft protrude from the timer casing unit and are inserted into corresponding one of the holes of the frame.

29. The timer according to claim 24, further comprising a hole formed on the timer casing unit, wherein one end of the pushing unit protrudes from the timer casing through the hole.

30. The timer according to claim 24, further comprising:

a hole formed on the timer casing unit; and an intermediate gear disposed between the power control shaft and the control gear shaft, having a protrusion formed on the intermediate gear, contacting the pushing unit through the hole.

31. The timer according to claim 24, wherein the pushing unit moves along an axis parallel to the control gear shaft and spaced apart from the control gear shaft.

32. The timer according to claim 24, wherein the power control cam comprises a side surface, an recess formed on the side surface, and an upper portion, and wherein the timer casing comprises an actuating lever disposed between the auxiliary power switch and the power control cam and disposed at one of the side surface, the recess, and the upper portion.

33. The timer according to claim 32, wherein the actuating lever is disposed at the upper portion of the power control cam when the power control cam is in the second state.

34. The timer according to claim 33, wherein the actuating lever is disposed at one of the side surface and the recess of the power control cam when the power control cam is in the second state.

35. A timer in a microwave oven, comprising:

a timer casing unit comprising:

a timer casing, a first hole, a second hole, and a third hole formed on the timer casing, a main power switch, a time control shaft unit disposed within the timer casing to turn on and off the main power switch and having a time control shaft protruding from the timer casing through the first hole to set a predetermined period of time, a power control shaft unit disposed outside the timer casing and setting a plurality of power levels, an auxiliary power switch, and a control gear shaft unit disposed within the timer casing to intermittently turn on and off the auxiliary power switch in response to one of the power levels during the predetermined period and having a control gear shaft protruding from the timer casing through the second hole to set on and off time of the auxiliary power switch; and a pushing unit disposed within the timer casing and between the control gear shaft unit and the power control shaft unit to control the control gear shaft unit in response to the power control shaft unit to intermittently turn on and off the auxiliary power switch, having an extension protruding from the timer casing through the third hole to communicate with the power control shaft unit, the pushing unit holding the power control shaft unit in response to the power control shaft unit to turn on the auxiliary power switch during the predetermined period when the one of the power level is a maximum power level.

* * * * *